US010245518B2

(12) United States Patent
Horikoshi et al.

(10) Patent No.: US 10,245,518 B2
(45) Date of Patent: Apr. 2, 2019

(54) TOY TOP

(71) Applicant: TOMY COMPANY, LTD., Tokyo (JP)

(72) Inventors: Kenji Horikoshi, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 15/960,972

(22) Filed: Apr. 24, 2018

(65) Prior Publication Data

US 2018/0311589 A1 Nov. 1, 2018

(30) Foreign Application Priority Data

Apr. 28, 2017 (JP) ..... 2017-089465

(51) Int. Cl.
*A63H 1/00* (2019.01)
*A63H 1/02* (2006.01)
*A63H 1/04* (2006.01)

(52) U.S. Cl.
CPC ..... *A63H 1/02* (2013.01); *A63H 1/00* (2013.01); *A63H 1/04* (2013.01)

(58) Field of Classification Search
CPC ..... A63H 1/00; A63H 1/04; A63H 1/20
See application file for complete search history.

(56) References Cited

U.S. PATENT DOCUMENTS 6,520,827 B1 * 2/2003 Liu ..... A63H 1/00 446/124
6,626,729 B2 * 9/2003 Osawa ..... A63H 1/00 446/250
7,740,518 B2 * 6/2010 Elliott ..... A63F 9/16 273/126 R
9,597,604 B1 3/2017 Horikoshi
10,118,103 B2 * 11/2018 Muraki ..... A63H 1/04
2011/0256795 A1 * 10/2011 Ujita ..... A63H 1/00 446/264
2011/0256796 A1 * 10/2011 Ujita ..... A63H 1/00 446/264

FOREIGN PATENT DOCUMENTS

CN 200995064 Y 12/2007
CN 201120144 Y 9/2008
(Continued)

OTHER PUBLICATIONS

Office Action for Japanese Patent Application No. 2017-089465, dated Oct. 10, 2017.
(Continued)

*Primary Examiner* — John Ricci
(74) *Attorney, Agent, or Firm* — Staas & Halsey LLP

(57) ABSTRACT

A toy top includes a shaft portion, a body and an attacking member. The body is rotatable relative to the shaft portion in response to an impact applied to the body. The attacking member is movably connected to the body to move in a predetermined direction relative to the body between first and second positions. In the second position, the attacking member protrudes from the body a variable protruding distance which varies according to the rotating position of the body relative to the shaft portion.

23 Claims, 9 Drawing Sheets

(56) References Cited

FOREIGN PATENT DOCUMENTS

| | | |
|---|---|---|
| JP | 3083443 U | 1/2002 |
| JP | 2003-62354 | 3/2003 |

OTHER PUBLICATIONS

Espacenet English Abstract for Chinese Patent Application No. 200995064, published Dec. 26, 2007.
Espacenet English Abstract for Chinese Patent Application No. 201120144, published Sep. 24, 2008.
European Patent Office English abstract for Japanese Patent Publication No. 2003-62354, published Mar. 4, 2003.
European Office Action dated Sep. 17, 2018 in Application No. 18169115.5.

* cited by examiner

TOY TOP

BACKGROUND OF THE INVENTION

1. Field of the Invention

The present invention relates to a toy top.

2. Description of Related Art

A battle game using toy tops that has been known in the art involves forcing toy tops to collide with each other so that a resultant impact force stops the spinning of an opponent toy top or knocks out or disassembles the opponent toy top.

Some of such toy tops are designed to include offensive strength and defensive strength that are changeable. For example, an attachment with a bump is attached to a toy body, and the bump has such a shape that allows changing the offensive or defensive strength (e.g. see Japanese Utility Model No. 3083443).

The attachment disclosed in Japanese Utility Model No. 3083443 is designed to impart different offensive strength and defensive strength according to whether it is attached in the face-up or face-down position, so that the offensive strength and the defensive strength are changeable by attaching it in the flipped position. However, the offensive strength and the defensive strength of such a toy top can only be changed by removing the attachment from the toy body, turning over the attachment, and remounting the attachment to the toy body.

SUMMARY OF THE INVENTION

An object of the present invention, which has been conceived in view of the above-described issue, is to provide a toy top having offensive strength that varies according to attacks received from an opponent toy top.

According to an aspect of the present invention, a toy top includes:

a shaft portion;

a body which is rotatable relative to the shaft portion in response to an impact applied to the body; and an attacking member movably connected to the body to move in a predetermined direction relative to the body between first and second positions, wherein in the second position the attacking member protrudes from the body a variable protruding distance which varies according to the rotating position of the body relative to the shaft portion.

The impact is caused by, for example, a collision of a spinning toy top with an opponent toy top or with a wall of a field.

Preferably, the predetermined direction is a radial direction relative to the body.

Preferably, the toy top further includes a limiter which engages the attacking member and limits the protruding distance of the attacking member according to the rotating position of the body relative to the shaft portion.

Preferably, the limiter defines an area in which the attacking member can move to vary the protruding distance of the attacking member.

Preferably, the limiter includes a cam extending between the body and the attacking member to vary the protruding distance of the attacking member.

Preferably, the body has one of projections and recesses, and the shaft portion has the other of the projections and recesses, and the projections and recesses cooperate when the body rotates relative to the shaft portion to provide a variable rotational rate in response to a collision with an opponent toy top.

Preferably, the toy top is movable between a coupled state and a decoupled state, the shaft portion and the body are in the coupled state when the shaft portion is positioned on the body and the body is rotated in a first direction relative to the shaft portion, and the shaft portion and the body are in the decoupled state when the body is rotated in a second direction relative to the shaft portion.

Preferably, the first position is fully retracted in the body.

Preferably, the body rotates together with the attacking member, the body further comprises a part which engages with the shaft portion and rotates together with the shaft portion, and the limiter is disposed on the part.

Preferably, the part engages with the shaft portion via a flywheel.

According to these configurations, the protruding distance varies depending on the rotating position of the body relative to the shaft portion. Thus, offensive strength varies according to attacks from an opponent toy top.

A toy top including a body rotatable at a variable rotational rate relative to a shaft portion in response to a collision with an opponent toy top is used in a battle game while maintaining offensive strength and defensive strength corresponding to the rotating position of the toy top at that time; thus, the players can enjoy a variety of battle games.

A toy top having offensive strength and defensive strength that vary to achieve the decoupling of the shaft portion and the body allows players to dramatically reverse the situation of the battle game. Thus, a thrilling battle game can be enjoyed. In particular, a toy top in which the attacking member protrudes a large distance when the main component rotates in the second direction relative to the shaft portion allows players to dramatically reverse the situation of the battle game. Thus, the user of the toy top will have an increased sense of emotional attachment to the toy top.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION

A toy top according to embodiments of the present invention will now be described with reference to the accompanying drawings.

Overall Configuration of First Embodiment

Figure 1:
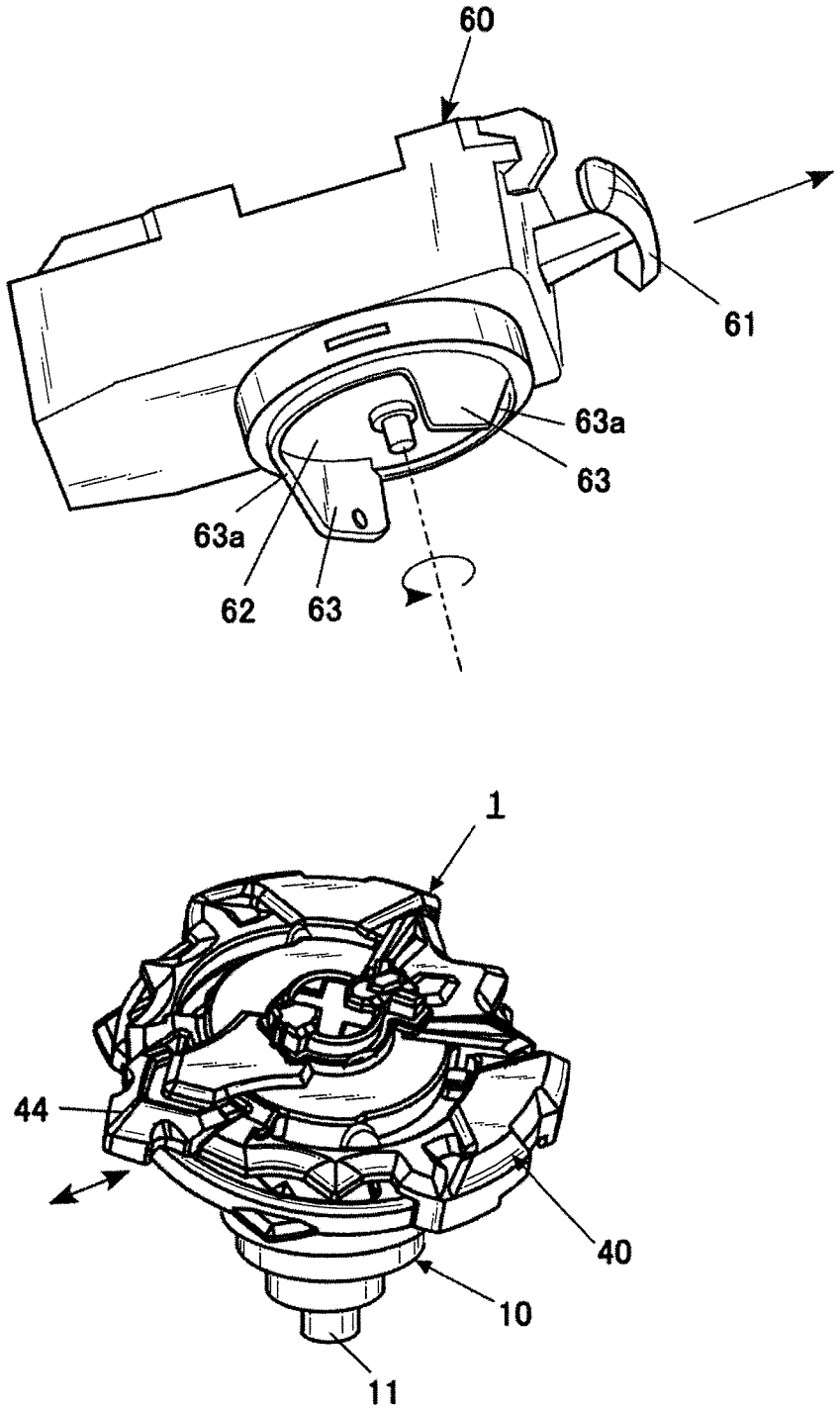
FIG. 1 is a perspective view of a toy top and a launcher according to a first embodiment.

FIG. 1 illustrates a toy set including a toy top 1 and a toy-top launcher 60 according to the first embodiment.

Figure 2:
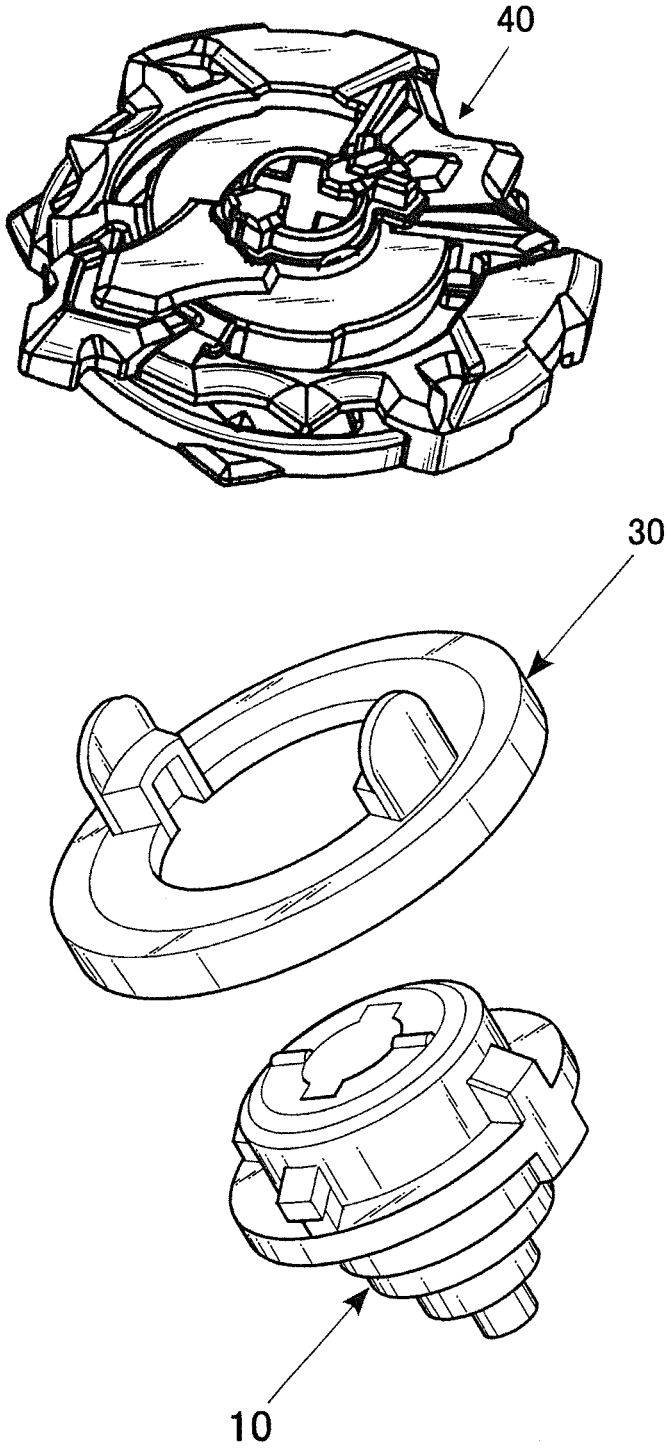
FIG. 2 is a perspective view of the toy top according to the first embodiment in action.

The toy top 1 is of a type that can be used in a so-called "top battle game." The toy top 1, for example, can be used in a battle game in which a player wins the game when an opponent toy top 1 is disassembled as illustrated in FIG. 2 by the impact force of a collision between toy tops.

With reference to FIG. 2, the toy top 1 is composed of a shaft portion 10, a flywheel 30, and a body 40.

Details

1. Shaft Portion 10

Figure 3:
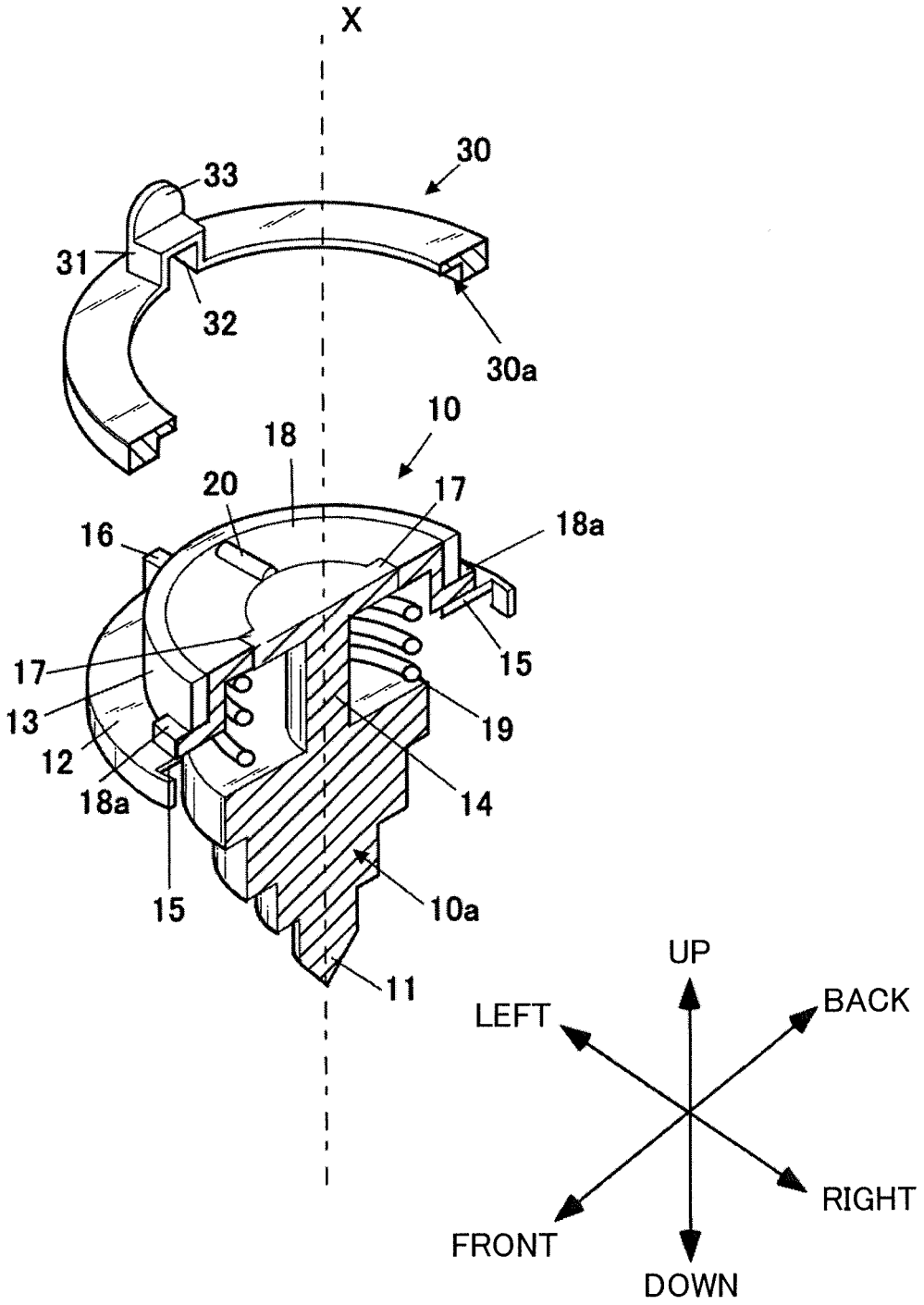
FIG. 3 is a cross-sectional perspective view of a portion of the toy top according to the first embodiment.

FIG. 3 is a perspective cross-sectional view of the shaft portion 10 and the flywheel 30. In the shaft portion 10 and the flywheel 30, the terms up-down, right-left and front-rear represent the respective directions as illustrated in FIG. 3. The shaft portion 10 and the flywheel 30 each have a substantially symmetrical shape.

The shaft portion 10 includes a ground contact or spinning shaft 11 in the lower end section, a flange 12 in the middle section in the up-down direction, and a cylinder 13 in the upper end section.

The flange 12 is integrated with the cylinder 13. The core of the cylinder 13 includes a post 14. The upper end of the post 14 has a large diameter. This large diameter portion has two hooks 17 protruding radially outward in the front and back directions. The post 14 is fixed to the lower shaft portion 10*a*. The circumferential face of the lower shaft portion 10*a* has a diameter that decreases stepwise from the flange 12 to the tip of the spinning shaft 11, defining an inverted substantial cone as a whole. The lower shaft portion 10*a* is fixed to the flange 12 with, for example, a screw (not shown).

Two holes 15 are formed in the front and back regions across the flange 12 and the cylinder 13. The circumferential face of the cylinder 13 has two protrusions 16 in the right and left regions. The outer faces of the protrusions 16 are flush with the circumferential face of the flange 12.

The shaft portion 10 includes a cylindrical urging member 18. The urging member 18 includes an annular top panel that fits to the upper end portion of the post 14. The urging member 18 is hollow and has a downward opening. The urging member 18 fits inside the cylinder 13 and surrounds the post 14. The circumferential face at the lower end of the urging member 18 has two legs 18*a* protruding radially outward in the front and back directions.

With reference to FIG. 3, the urging member 18 is assembled such that the legs 18*a* are exposed from the respective holes 15. The holes 15 allow the respective legs 18*a* to move in the up-down direction therein. The upward movement, however, is limited by the upper edges of the holes 15. The urging member 18 is urged upward by a spring 19. In a normal state, the upper end face of the urging member 18 is substantially flush with the upper edge of the cylinder 13.

The upper face of the urging member 18 has two ridges 20 radially extending in the left and right directions.

2. Flywheel 30

The flywheel 30 has an annular shape. The inner bottom face of the flywheel 30 has an annular step 30*a* that accommodates the flange 12 of the shaft portion 10 disposed below. The upper face of the flywheel 30 has two upward protrusions 31 extending in the right and left directions. In lower parts of the protrusions 31, recesses 32 are formed so that the protrusions 16 of the shaft portion 10 can be respectively received therein. The upper face of the flywheel 30 has tongues 33 adjoining the outer faces of the protrusions 31 and extending upward. The tongues 33 protrude above the protrusions 31.

3. Body 40

Figure 4:
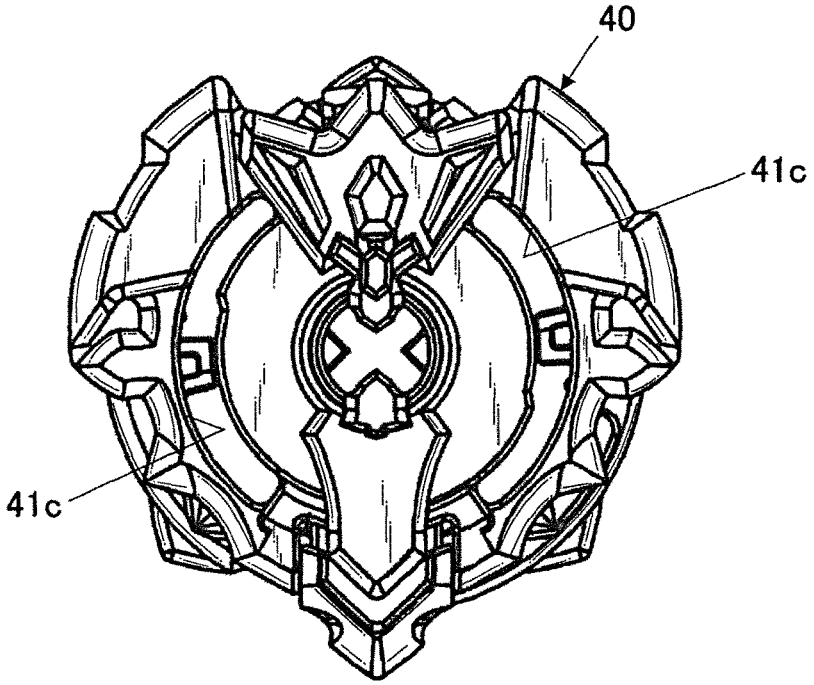
FIG. 4 is a plan view of a body of the toy top according to the first embodiment.
Figure 5:
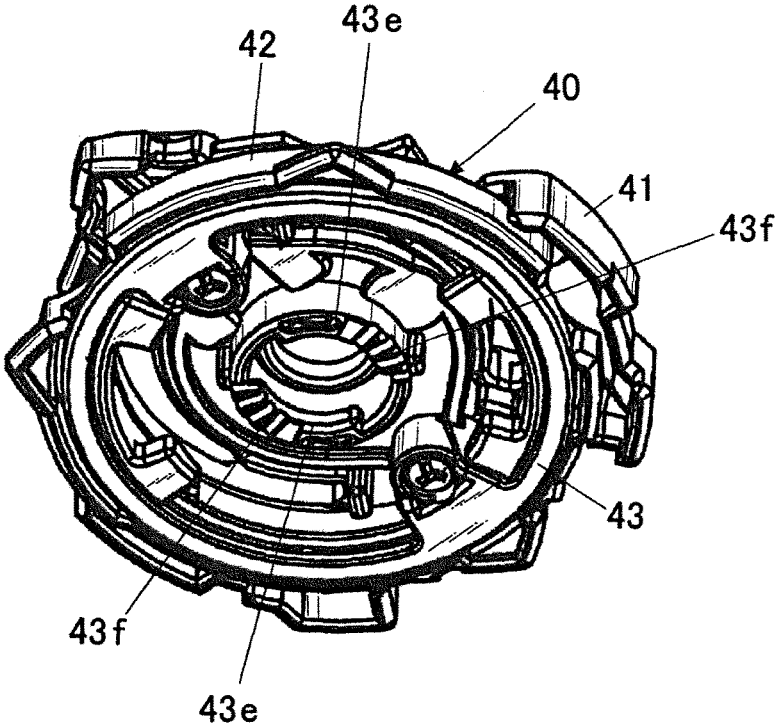
FIG. 5 is a bottom perspective view of the body of the toy top according to the first embodiment.
Figure 6:
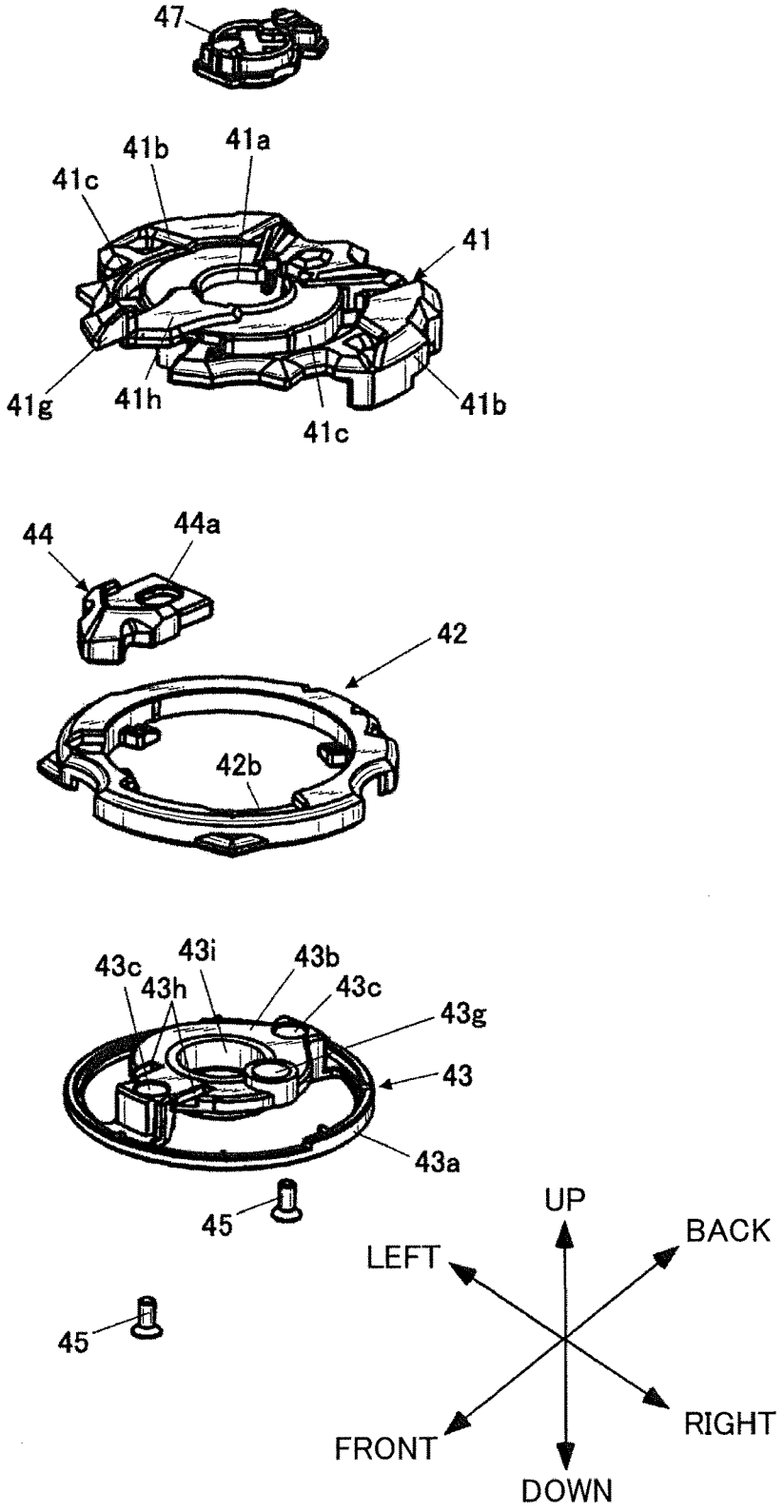
FIG. 6 is an exploded top perspective view of the body of the toy top according to the first embodiment.
Figure 7:
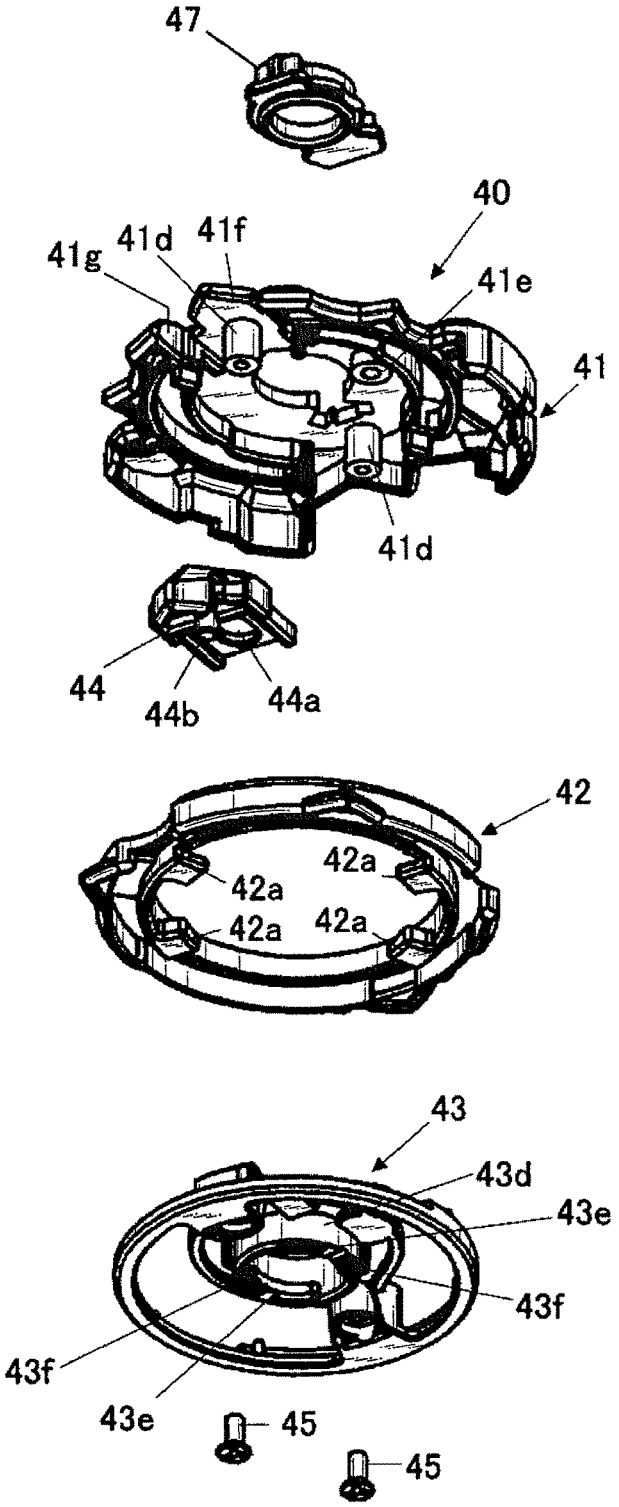
FIG. 7 is an exploded bottom perspective view of the body of the toy top according to the first embodiment.

FIG. 4 is a plan view of the body 40. FIG. 5 is a bottom perspective view of the body 40. FIG. 6 is an exploded top perspective view of the body 40. FIG. 7 is an exploded bottom perspective view of the body 40. With reference to FIGS. 6 and 7, the body 40 includes a top plate 41, a middle plate 42, and a bottom plate 43. The top plate 41 and the bottom plate 43 constitute a main component which is a first body part. The middle plate 42 constitutes a second body part. In the body 40, the terms "top," "bottom," "left," "right," "front," and "back" refer to the corresponding directions in FIG. 6.

(i) Top Plate 41

The top plate 41 has a substantially circular hole 41*a* in the central area. The top plate 41 has two extensions 41*b* extending radially outward in the right and left directions. The upper face of the top plate 41 has two arcuate slits 41*c* that receive the tongues 33 of the flywheel 30 disposed below in the right and left regions (see FIG. 4). The width of each arcuate slit 41*c* is large at one end and small at the other end in the circumferential direction.

The bottom face of the top plate 41 has two cylindrical bosses 41*d* in the front and back regions. The inner faces of the holes in the central areas of the bosses 41*d* have internal threads (not shown). The bottom face of the top plate 41 has a positioning boss 41*e*.

The front of the upper face of the top plate 41 has an acuate retainer plate 41*h* extending inside a recess 41*g*. The recess 41*g* opens radially outward.

(ii) Middle Plate 42

The middle plate 42 has an annular shape. The inner wall of the middle plate 42 has two pairs of lugs 42*a* protruding inward from the right and left regions of the middle plate 42. The distance between the lugs 42*a* in each pair is large enough to accommodate the corresponding tongue 33. Thus, the tongues 33 are held between the corresponding pairs of lugs 42*a* when the shaft portion 10 and the body 40 are assembled. When the shaft portion 10 and the flywheel 30 rotate relative to the top plate 41 and the bottom plate 43, the middle plate 42 rotates together with the tongues 33 relative to the top plate 41 and the bottom plate 43.

Figure 8:
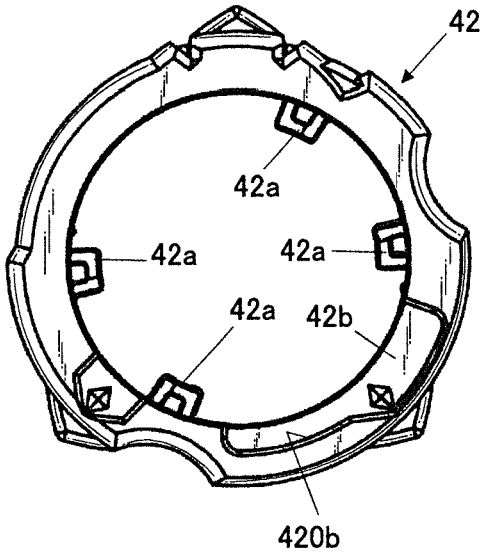
FIG. 8 is a plan view of a middle plate of the toy top according to the first embodiment.

FIG. 8 is a plan view of the middle plate 42. As illustrated, the upper face of the middle plate 42 has a depression 42*b* in the front right area. The depression 42*b* constitutes a protrusion limiter. The depression 42*b* opens radially inward from the top of the middle plate 42. The width of the depression 42*b* is small at one end and large at the other end in the circumferential direction. Thus, one end of a sidewall 420*b* defining the depression 42*b* is disposed further outward in the radial direction than the other end, on top view.

(iii) Bottom Plate 43

The bottom plate 43 includes an annular frame 43*a*. The interior of the frame 43*a* is provided with a connector 43*b* supporting the frame 43*a*. The connector 43*b* has a hole 43*i* in the central area. The connector 43*b* has two through-holes 43*c* in the front and back regions. The bosses 41*d* pass through the respective through-holes 43*c*.

The bottom face of the bottom plate 43 has an annular wall 43*d* having a diameter equal to that of the hole 43*i*. The lower inner face of the annular wall 43*d* has two hooks 43*e* disposed opposite each other across the core and extending radially inward. One end of the lower face of each hook 43*e* has undulations 43*f* that engage with the ridges 20 of the shaft portion 10. The undulations 43*f* include several ridges disposed in the circumferential direction.

Figure 9A:
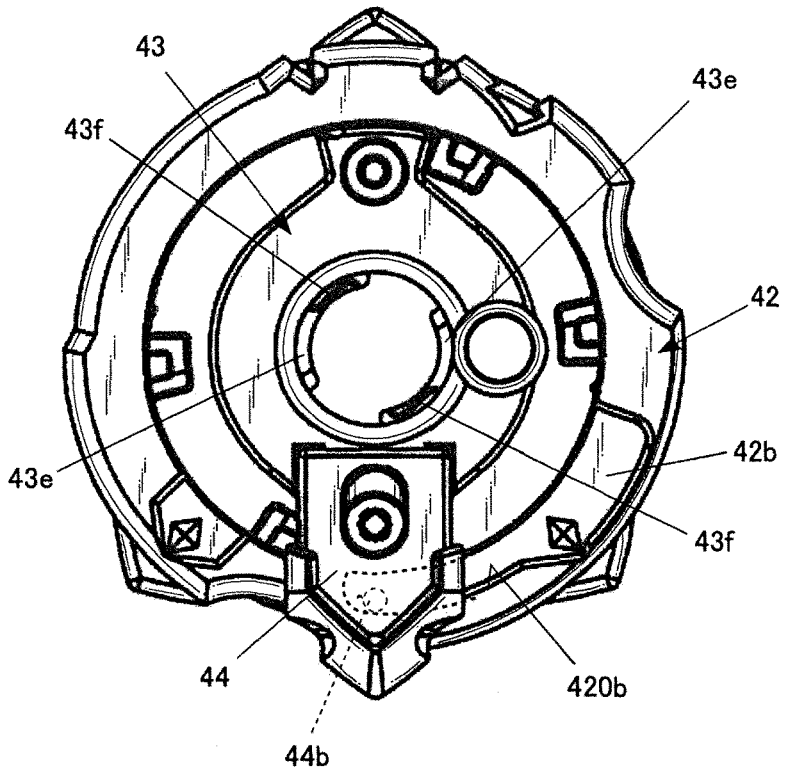
FIG. 9A is a plan view of an attacking member in an initial state for illustrating the operation of the toy top according to the first embodiment.
Figure 9B:
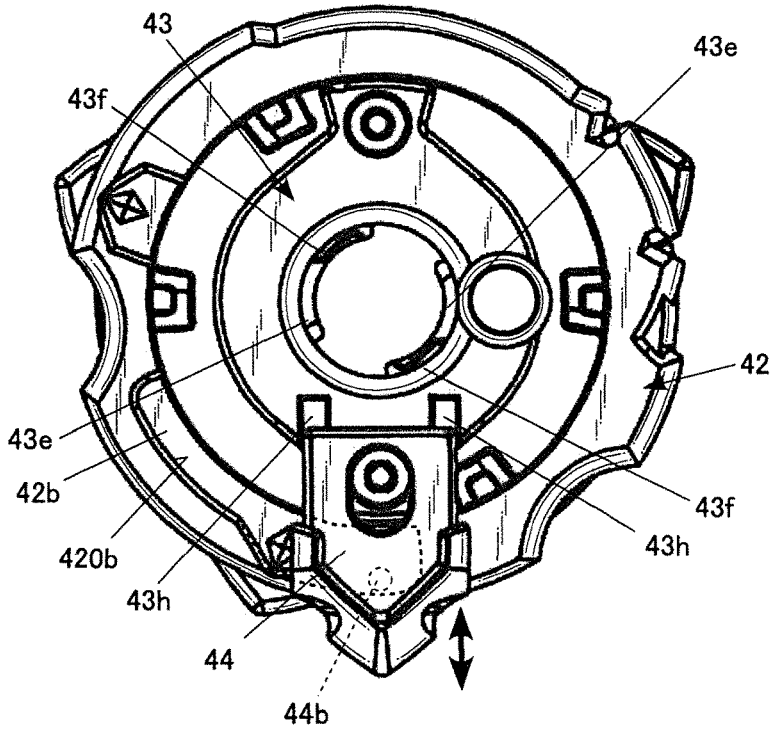
FIG. 9B is a plan view of the attacking member in a maximum protruding state for illustrating the operation of the toy top according to the first embodiment.

The upper face of the connector 43*b* has a hole 43*g* that fits to the positioning boss 41*e*. The upper face of the connector 43*b* has two guide grooves 43*h* that engage with a sidewall of an attacking member 44 described below and guides the attacking member 44 to move in the radial direction (see FIG. 9B).

(iv) Attacking Member 44

The attacking member 44 is fixed to the body 40. The attacking member 44 has an acuate tip in top view and a substantially pentagonal shape in overall view. The attacking member 44 is disposed inside the recess 41*g*. The attacking member 44 is movable in the radial direction of the toy top 1. The radial movement is guided by the sidewall of the recess 41*g* and the guide grooves 43*h*.

The attacking member 44 is assembled as described below.

The boss 41*d* disposed at the front of the top plate 41 is inserted from above into an elongated hole 44*a* in the attacking member 44. The attacking member 44 is held between the retainer plate 41*h* of the top plate 41 and the middle plate 42. Then external threads 45 are screwed into the internal threads of the respective bosses 41*d* through the through-holes 43*c* in the bottom plate 43 to mount the attacking member 44. After mount of the attacking member 44, the columnar protrusion 44*b* disposed on the bottom face of the attacking member 44 resides on the depression 42*b*. The attacking member 44 can move radially outward until the protrusion 44*b* comes into contact with the sidewall 420*b* of the depression 42*b*. In this embodiment, the attacking member 44 rotates together with the top plate 41 and the bottom plate 43. Thus, the middle plate 42 rotates together with the depression 42*b* relative to the top plate 41 and the middle plate 42 in response to a collision with an opponent toy top 1. This causes a variation in movable area of the attacking member 44 in the radial direction.

(v) Decorative Component 47

A decorative component 47 is disposed in the hole 41*a* in the top plate 41. The decorative component 47 is provided for distinguishing the toy top 1 from an opponent toy top. Multiple decorative components having upper faces of different colors and/or shapes may be provided.

4. Assembly of Toy Top 1

Assembly of the toy top 1 will now be described. At this point, the assembly of the shaft portion 10 and the body 40 should already be completed as illustrated in FIG. 2.

In the first stage, the protrusions 16 of the shaft portion 10 are aligned with the respective recesses 32 of the flywheel 30 from below, so as to fit the shaft portion 10 with the flywheel 30. In the second stage, this fitted body is moved close to the body 40 from below. Before this stage, the middle plate 42 should be preliminarily rotated relative to the top plate 41 and the bottom plate 43 to a predetermined position such that the protrusion 44*b* of the attacking member 44 resides on the broad side of the depression 42*b*.

The tongues 33 of the flywheel 30 are then inserted to the respective arcuate slits 41*c* in the body 40 such that the tongues 33 of the flywheel 30 are disposed between the respective pairs of lugs 42*a* of the middle plate 42. In this state, the hooks 17 of the shaft portion 10 are not aligned with the hooks 43*e* of the body 40 in the up-down direction. This state is referred to as a decoupled state. The shaft portion 10 of the fitted body is then urged toward the body 40. In response, the flywheel 30 is urged to the bottom face of the body 40. The spring 19 in the shaft portion 10 then contracts, and the urging member 18 sinks. This causes the hooks 17 of the shaft portion 10 to be relatively urged above the hooks 43*e* of the body 40. The shaft portion 10 is turned together with the flywheel 30 in a predetermined direction (the direction opposite to the rotating direction of the toy top 1) relative to the top plate 41 and the bottom plate 43. This causes the hooks 43*e* of the body 40 to move beneath the hooks 17 of the shaft portion 10, such that the hooks 17 are aligned with the hooks 43*e* in the up-down direction. In response to the removal of the hand of the player from the shaft portion 10, the lower faces of the hooks 17 of the shaft portion 10 come into contact with the upper faces of the hooks 43*e* of the body 40 due to the urging force of the spring 19 inside the shaft portion 10. This state in which the lower faces of the hooks 17 of the shaft portion 10 are in contact with the upper faces of the hooks 43*e* of the body 40 is referred to as a coupled state. As a result, the ridges 20 engage with the undulations 43*f*, and the toy top 1 is assembled. In this state, the protrusion 44*b* of the attacking member 44 resides at the narrow side of the depression 42*b*, and the protrusion 44*b* comes into contact with the sidewall 420*b* at the narrow side of the depression 42*b*. Thus, the attacking member 44 is prevented from moving radially outward.

5. How to Play

An example of how to play with the toy top 1 will now be described.

FIG. 1 is a perspective view of an exemplary launcher that rotationally drives the toy top 1.

In this example of how to play, the toy top 1 is spun to engage in a battle with an opponent toy top 1.

In such a case, the rotational force of the toy top 1 is generated with a launcher 60, such as that illustrated in FIG. 1. The launcher 60 includes an internal disk (not shown). The disk is urged in a first rotational direction by a spiral spring (not shown). A handle 61 is then pulled to pull a string (not shown) wound around the disk so as to spin the disk, thereby spinning a top holder 62. The spinning of the top holder 62 is transmitted to the toy top 1 through a fork 63 protruding downward so as to spin the toy top 1. In such a case, the fork 63 are inserted into the arcuate slits 41*c* in the body 40. Fully pulling the handle 61 of the launcher 60 stops the spinning of the disk and thus the spinning of the top holder 62, but the toy top 1 continues to spin due to inertia. The toy top 1 follows the tilting faces 63*a* of the fork 63 and detaches from the top holder 62.

The toy top 1 launched in this way spins in a predetermined direction in a predetermined field and collides with another toy top 1 of an opponent spinning in the same direction, for example. The impact force generated by the collision causes a reactive force to be applied to the top plate 41 and the bottom plate 43 in a direction opposite to the rotational direction of the shaft portion 10 and the flywheel 30. This causes the top plate 41 and the bottom plate 43 to spin in the opposite direction relative to the rotational direction of the shaft portion 10 and the flywheel 30.

In response, the undulations 43*f* on the lower face of the bottom plate 43 and the ridges 20 engage at stepwise varying positions as the shaft portion 10 rotates relative to the top plate 41 and the bottom plate 43. The middle plate 42 rotates together with the flywheel 30 and thus rotates together with the shaft portion 10. Thus, the protrusion 44*b* of the attacking member 44 moves on the broad side of the depression 42*b*. This expands the moveable area of the attacking member 44, and the attacking member 44 moves radially outward due to a centrifugal force. In this state, the attacking member 44 readily collides with the opponent toy top. The collision of the attacking member 44 with the opponent toy top causes the attacking member 44 to continue to rotate together with the shaft portion 10, thereby the attacking member 44 can apply a more intense impact to the opponent toy top.

Second Embodiment

Figure 10:
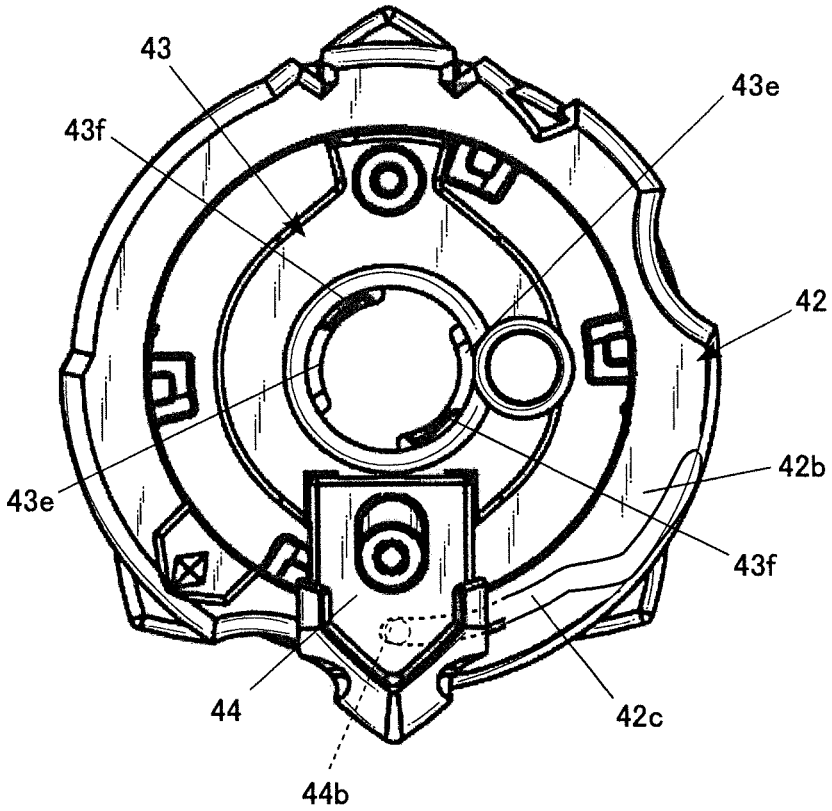
FIG. 10 is a plan view of a portion of a body of a toy top according to a second embodiment.

FIG. 10 illustrates a body 40 according to a second embodiment without a top plate 41. In the first embodiment, the middle plate 42 rotates from the initial position relative to the top plate 41 and the bottom plate 43, to expand the movable area of the attacking member 44. In contrast, in the second embodiment, a cam (for example, a grooved cam) 42*c* is used in place of the depression 42*b*, and the middle plate 42 rotates from the initial position relative to the top plate 41 and the bottom plate 43, to force the attacking member 44 to move in the radial direction. In such a case, the movable area of the attacking member 44 may be maximized or minimized at an intermediate position of the middle plate 42 moving relative to the top plate 41 and the bottom plate 43 from the coupled state to the decoupled state.

Other configurations of the second embodiment are the same as those of the first embodiment. Thus, duplicative illustrations and descriptions are omitted. The cam 42*c* may be of any type, for example, a disk cam or a positive cam.

Alternate Embodiments of the Invention

The above embodiments should not be construed to limit the present invention and may be appropriately modified within the gist of the present invention.

For example, in the toy top 1 according to the embodiments described above, the main component and the shaft portion 10 are coupled by relative rotation of the main component and the shaft portion 10 in a first direction and decoupled by relative rotation of the main component and the shaft portion 10 in a second direction. The present invention may also be applied to a toy top 1 including a body 40 and a shaft portion 10 that is not decoupled by mere rotation of the main component and the shaft portion 10 relative to each other around an axis.

In the embodiment described above, the movable area of the attacking member 44 expands in response to the middle plate 42 moving relative to the top plate 41 and the bottom plate 43 from the coupled position to the decoupled position. In contrast, the movable area of the attacking member 44 may be reduced in response to the middle plate 42 moving relative to the top plate 41 and the bottom plate 43 from the coupled position to the decoupled position. The movable area of the attacking member 44 may be maximized or minimized at an intermediate position of the middle plate 42 moving relative to the top plate 41 and the bottom plate 43 from the coupled position to the decoupled position.

In the embodiment described above, one attacking member 44 is provided. Alternatively, two or more attacking members 44 may be provided along the circumferential direction.

In the embodiment described above, the main component (first body part) includes the top plate 41 and the bottom plate 43. Alternatively, the main component may include either the top plate 41 or the bottom plate 43.

The attacking member 44 may constantly protrude from the main component by a variable protruding distance. Alternatively, the attacking member 44 may shift between a retracted state in which the attacking member 44 is hidden in the main component and a protruding state in which the attacking member 44 protrudes from the main component. The attacking member 44 may constantly protrude more radially outward than the extensions 41*b* of the main component by a variable protruding distance. Alternatively, the attacking member 44 may shift between a retracted state in which the attacking member 44 is disposed more radially inward than the extensions 41*b* of the main component and a protruding state in which the attacking member 44 protrudes more radially outward than the extensions 41*b*.

For the attacking member 44 to effectively function, it is preferred that the attacking member 44 enter a protruding state in which the attacking member 44 protrudes more radially outward than the extensions 41*b* of the main component.

In the embodiment described above, the attacking member 44 is movable in the radial direction. Alternatively, the attacking member 44 may be movable in the radial direction and then in the parallel direction. Alternatively, the attacking member 44 may be movable in the up-down direction of the main component.

The entire disclosure of Japanese patent application No. 2017-089465, filed on Apr. 28, 2017, is incorporated herein by reference in its entirety.

What is claimed is:

1. A toy top comprising:

a shaft portion;

a body which is rotatable relative to the shaft portion in response to an impact applied to the body; and an attacking member movably connected to the body to move in a predetermined direction relative to the body between first and second positions, wherein in the second position the attacking member protrudes from the body a variable protruding distance which varies according to the rotating position of the body relative to the shaft portion.

2. The toy top according to claim 1, wherein the predetermined direction is a radial direction relative to the body.

3. The toy top according to claim 1, further comprising:

a limiter which engages the attacking member and limits the protruding distance of the attacking member according to the rotating position of the body relative to the shaft portion.

4. The toy top according to claim 3, wherein the limiter defines an area in which the attacking member can move to vary the protruding distance of the attacking member.

5. The toy top according to claim 3, wherein the limiter includes a cam extending between the body and the attacking member to vary the protruding distance of the attacking member.

6. The toy top according to claim 5, wherein the cam is selected from a grooved cam, a disk cam or a positive cam.

7. The toy top according to claim 3, wherein the body rotates together with the attacking member, wherein the body further comprises a part which engages with the shaft portion and rotates together with the shaft portion, and wherein the limiter is disposed on the part.

8. The toy top according to claim 7, wherein the part engages with the shaft portion via a flywheel.

9. The toy top according to claim 7, wherein the limiter is a continuous depression formed in the part and the depression has a first end that is smaller than a second, opposite end of the depression.

10. The toy top according to claim 9, wherein the attacking member includes a projection, the attacking member is in the second position when the projection is in the second end, and the attacking member is in the first position when the projection is in the first end.

11. The toy top according to claim 7, wherein the body is two spaced plates between which the part, which is also a plate, is received.

12. The toy top according to claim 1, wherein the body has one of projections and recesses, and the shaft portion has the other of the projections and recesses, and wherein the projections and recesses cooperate when the body rotates relative to the shaft portion to provide a variable rotational rate in response to a collision with an opponent toy top.

13. The toy top according to claim 1, wherein the toy top is movable between a coupled state and a decoupled state, wherein the shaft portion and the body are in the coupled state when the shaft portion is positioned on the body and the body is rotated in a first direction relative to the shaft portion, and wherein the shaft portion and the body are in the decoupled state when the body is rotated in a second direction relative to the shaft portion.

14. The toy top according to claim 13, wherein the first position is fully retracted in the body.

15. The toy top according to claim 1, wherein the body has a circumference, wherein the attacking member is a plurality of attacking members attached to the circumference, and wherein each of the attacking members moves radially relative to the body between the first and second positions.

16. A toy top comprising:

a shaft portion;

a body which is removably connected to the shaft portion and is rotatable relative to the shaft portion in response to an impact applied to the body;

an attacking member movably connected to the body to move radially relative to the body between first and second positions; and a limiter which engages the attacking member, wherein in the second position the attacking member protrudes from the body a variable protruding distance which varies according to the rotating position of the body relative to the shaft portion, and wherein the limiter limits the protruding distance of the attacking member according to the rotating position of the body relative to the shaft portion.

17. The toy top according to claim 16, wherein the body rotates together with the attacking member, wherein the body further comprises a part which engages with the shaft portion and rotates together with the shaft portion, and wherein the limiter is disposed on the part.

18. The toy top according to claim 17, wherein the part engages with the shaft portion via a flywheel.

19. The toy top according to claim 17, wherein the body is two spaced plates between which the part, which is also a plate, is received.

20. The toy top according to claim 16, wherein the body has a circumference, and wherein the attacking member is a plurality of attacking members attached to the circumference.

21. The toy top according to claim 16, wherein the limiter is a continuous depression formed in the part and the depression has a first end that is smaller than a second, opposite end of the depression.

22. The toy top according to claim 21, wherein the attacking member includes a projection, the attacking member is in the second position when the projection is in the second end, and the attacking member is in the first position when the projection is in the first end.

23. A toy top comprising:

a shaft portion;

a body which is removably connected to the shaft portion and is rotatable relative to the shaft portion in response to an impact applied to the body;

an attacking member movably connected to the body to move radially relative to the body between first and second positions; and a limiter which engages the attacking member;

wherein in the second position the attacking member protrudes from the body a variable protruding distance which varies according to the rotating position of the body relative to the shaft portion; and wherein the limiter limits the protruding distance of the attacking member according to the rotating position of the body relative to the shaft portion, wherein the body rotates together with the attacking member, wherein the body further comprises a part which engages with the shaft portion and rotates together with the shaft portion, wherein the limiter is disposed on the part and is a continuous depression formed in the part, and wherein the depression has a first end that is smaller than a second, opposite end of the depression.

* * * * *